US006138297A

United States Patent [19]

Harris et al.

[11] Patent Number: 6,138,297

[45] Date of Patent: Oct. 31, 2000

[54] GRAVITY BALL VALVE AND OPERATING MECHANISM

[76] Inventors: Robert J Harris; Dawn Harris, both of 52-71 84th St., Elmhurst, N.Y. 11373

[21] Appl. No.: 09/336,853

[22] Filed: Jun. 21, 1999

[51] Int. Cl.[7] ..... E03C 1/23

[52] U.S. Cl. ..... 4/689; 4/692

[58] Field of Search ..... 4/688–682

[56] References Cited

U.S. PATENT DOCUMENTS

| | | | |
|---|---|---|---|
| 1,857,054 | 5/1932 | Luppes | 4/688 |
| 3,010,118 | 11/1961 | Isherwood | 4/688 |
| 3,110,323 | 11/1963 | Helguera . | |
| 3,314,083 | 4/1967 | Minella . | |
| 3,314,086 | 4/1967 | Minella . | |
| 3,315,279 | 4/1967 | Nolan | 4/682 |
| 4,192,026 | 3/1980 | Williams | 4/692 |
| 4,380,834 | 4/1983 | Wentz . | |
| 5,290,008 | 3/1994 | Young | 251/99 |

*Primary Examiner*—Charles R. Eloshway
*Attorney, Agent, or Firm*—Michael I. Kroll

[57] ABSTRACT

A removable pop-up ball valve 34 situated beneath the strainer area 22 of a sink 12 above the wastewater discharge pipe 32. The pop-up valve 34 has a remote control rod 30 whereby the valve 34 is opened and closed. The pop-up valve ball valve 34 which is actuated by a stem 54 which moves from an engaging to a non-engaging position by way of a pivot rod 46 pivotally operated and connected to a pivot ball 48 connected through a clevis 40, 44 in the standard manner to the remotely positioned control handle.

1 Claim, 7 Drawing Sheets

GRAVITY BALL VALVE AND OPERATING MECHANISM

BACKGROUND OF THE INVENTION

1. Field of the Invention

The present invention relates generally to pop-up valves and, more specifically, to a removable pop-up valve device having a remote actuator to open and close said valve for sinks having a basket strainer. Said pop-up valve device comprises a waste pipe insert housing a ball valve which is activated by a valve stem which moves from an engaging to a non-engaging position by means of a pivotally connected ball and socket valve stem guide connected through a clevis by means of a spring. Said clevis has threaded attachment means to the external valve control lift rod.

2. Description of the Prior Art

There are other pop-up valve device. Typical of these is U.S. Pat. No. 4,380,834 issued to Wentz on Apr. 26, 1983.

Another patent was issued to Minella on 3,314,083 as U.S. Pat. No. 3,314,083. Yet another U.S. Pat. No. 3,110,323 was issued to Helguera on Nov. 12, 1963 and still yet another was issued on Apr. 18, 1967 to Minella as U.S. Pat. No. 3,314,086.

U.S. Pat. No. 4,380,834

Inventor: Frederick E. Wentz

Issued: April 26, 1983

A pop-up plunger for selectively closing a generally cylindrical waste drain pipe having a seat at one end and a closure actuator remote from the seat, the plunger comprises a head portion including sealing means for engaging the seat for closing the waste drain pipe. The plunger also includes a support portion which extends from the head portion into the waste drain pipe. The support portion engages the closure actuator for axial displacement of the plunger relative to the waste drain pipe for opening and closing the waste drain pipe and includes guide means projecting into close proximity to the waste drain pipe for guiding the axial displacement of the plunger. The guide means provides at least one drain passage past the plunger to afford communication from the seat to a drain through the waste drain pipe. A hollow cylindrical foremenous sleeve member is releasably mounted on the guide means to cover the drain passage and to fill the space between the guide means and the inner surface of the waste drain pipe adjacent to the seat. The openings of the sleeve member afford a flow of waste liquid therethrough but block the passage of discrete articles. The sleeve member is held captive between the head and shoulders on the support and may be removed by disengagement of the head from the support while it remains coupled to the closure actuator.

U.S. Pat. No. 3,314,083

Inventor: Angelo Minella

Issued: Apr. 18, 1967

This United States patent discloses a concealed pop-up waste valve for receptacles designed to prevent access thereto. Said invention substantially comprises a pop-up valve operating in a tailpipe having a recessed seat for said valve.

U.S. Pat. No. 3,110,323

Inventor: Carlos Helguera

Issued: Nov. 12, 1963

This United States patent discloses a drain strainer comprised of a radially slotted fixed plate and a rotatable closure plate positioned there beneath and being similarly slotted. The partial rotation of the movable plate will close the slots, and additional rotation, in a reverse direction will align the slots in the plates to permit drainage of the material in the basin. Further the rotative movement of the lower valve closure is imparted by linear motion from a remotely positioned handle, extending exteriorly of the basin.

U.S. Pat. No. 3,314,086

Inventor: Angelo Minella

Issued: Apr. 18, 1967

This United States patent discloses a valve seat and push rod or stem for a pop-up waste valve concealed in a tamper proof housing positioned below strainer means for preventing hair, lint, buttons, tube caps, and other small articles from passing through the valve to the waste line.

While these pop-up valves may be suitable for the purposes for which they were designed, they would not be as suitable for the purposes of the present invention, as hereinafter described.

SUMMARY OF THE PRESENT INVENTION

The present invention discloses a removable pop-up ball valve situated beneath the strainer area of a sink above the wastewater discharge pipe. The pop-up valve has a remote control rod whereby the valve is opened and closed. The pop-up valve comprises a ball valve which is actuated by a stein which moves from an engaging to a non-engaging position by means of a pivot rod pivotally operated and connected to a pivot ball connected through a clevis in the standard manner to the remotely positioned control handle.

A primary object of the present invention is to provide a pop-up valve for the kitchen sink.

Another object of the present invention is to provide a pop-up valve for the kitchen having an external actuator for said valve.

Yet another object of the present invention is to provide a pop-up valve for the kitchen sinks which can be removed through the waste pipe aperture located within the interior of the sink.

Additional objects of the present invention will appear as the description proceeds.

The present invention overcomes the shortcomings of the prior art by providing a removable pop-up valve device having a remote actuator to open and close said valve for sinks having a basket strainer. Said pop-up valve device comprises a waste pipe insert housing a ball valve which is activated by a valve stem which moves from an engaging to a non-engaging position by means of a pivotally connected ball and socket valve stem guide connected through a clevis by means of a spring. Said clevis has threaded attachment means to the external valve control lift rod.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawing in which.

LIST OF REFERENCE NUMERALS

Figure 1A:
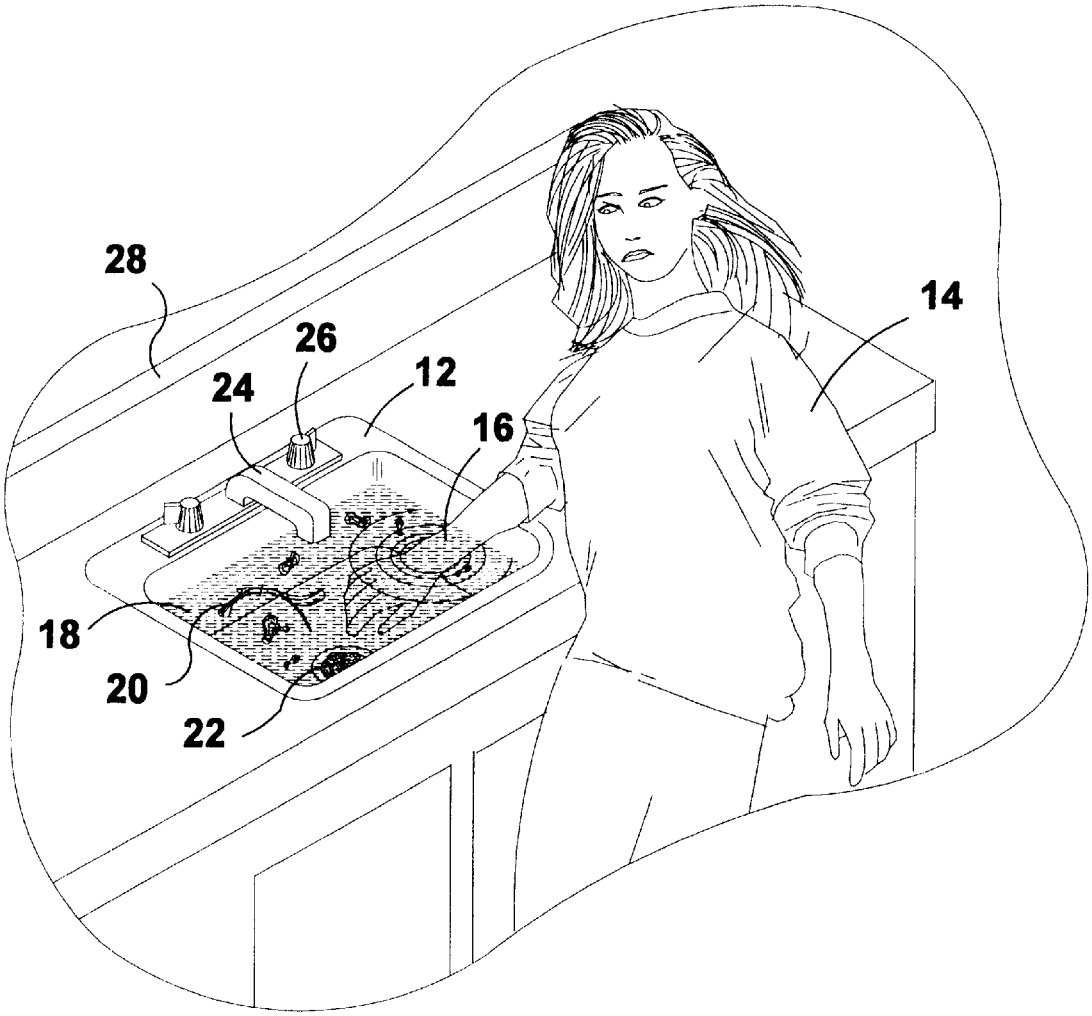
FIG. 1A is an illustration of a typical kitchen sink in use where by a user has to stick their hand into waste water which contains particle matter and bacteria which can be a health hazard because of water bourne bacteria and a tendency by many people to wipe their face with the back of their hand because of perspiration or an itch or speedily wipe their hands on towels because the phone ring or the doorbell or a child needs attention. All of these conditions not only jeopardize the dish washer but those who come into contact with them. There are also the dishtowels which are left hanging out wet for other people to use. All of these conditions contribute to ill health within a home. A common solution to these problems are that many people run a sink with water and soap and leave them to soak and it is the intent of the present invention to provide a means for discharging this waste water without having to stick a hand in to pull out the strainer or to try and manipulate the strainer into a position where it will release the water and not the particle matter down the waste pipe.

With regard to the reference numerals used, the following numbering is used throughout the drawings.

10 present invention
12 kitchen sink
14 user
16 hand
18 wastewater
20 solid waste matter
22 strainer
24 faucet
26 handles
28 cabinet
30 remote valve control
32 waste pipe
34 ball valve
36 waste pipe aperture
38 extension rod
40 U-shaped connecting means
42 tightening screw
44 connecting means
46 rod
48 pivot ball
50 bustling for pivot ball
51 eye
52 connecting member
53 connecting means
54 stem rod
56 ball valve seat
58 alignment collar
59 aperture
60 drain flange housing
61 threads
62 locking means
64 interior lower flange
66 aperture
68 washer
70 locking means

DESCRIPTION OF THE PREFERRED EMBODIMENTS

Turning now descriptively to the drawings, in which similar reference characters denote similar elements throughout the several views, FIGS. 1 through 6 illustrate the present invention being a removable pop-up ball drain valve for a kitchen sink having a remote control handle.

Turning to FIG. 1A, therein is shown an illustration of a typical kitchen sink 12 in use whereby the user 14 has to stick their hand 16 into dishwater 18 which contains particle matter 20 and associated bacteria which can be a health hazard because of the associated waterborne bacteria and the tendency of many people to wipe their face with the back of their hands because of perspiration or due to itching. All of these conditions not only jeopardize the dishwater 18 but those who come into contact with the user 14. All of these conditions contribute to ill health within a home. The present invention 10 (not shown) provides means for discharging the wastewater 18 without having to stick a hand 16 into the wastewater in order to pull the strainer 22 out or try and manipulate the strainer into a position where it will release the water. Also shown is the kitchen sink faucet 24, hot and cold water control knobs or handles 26, and the kitchen cabinet 28 within which the sink 12 is mounted.

Figure 1B:
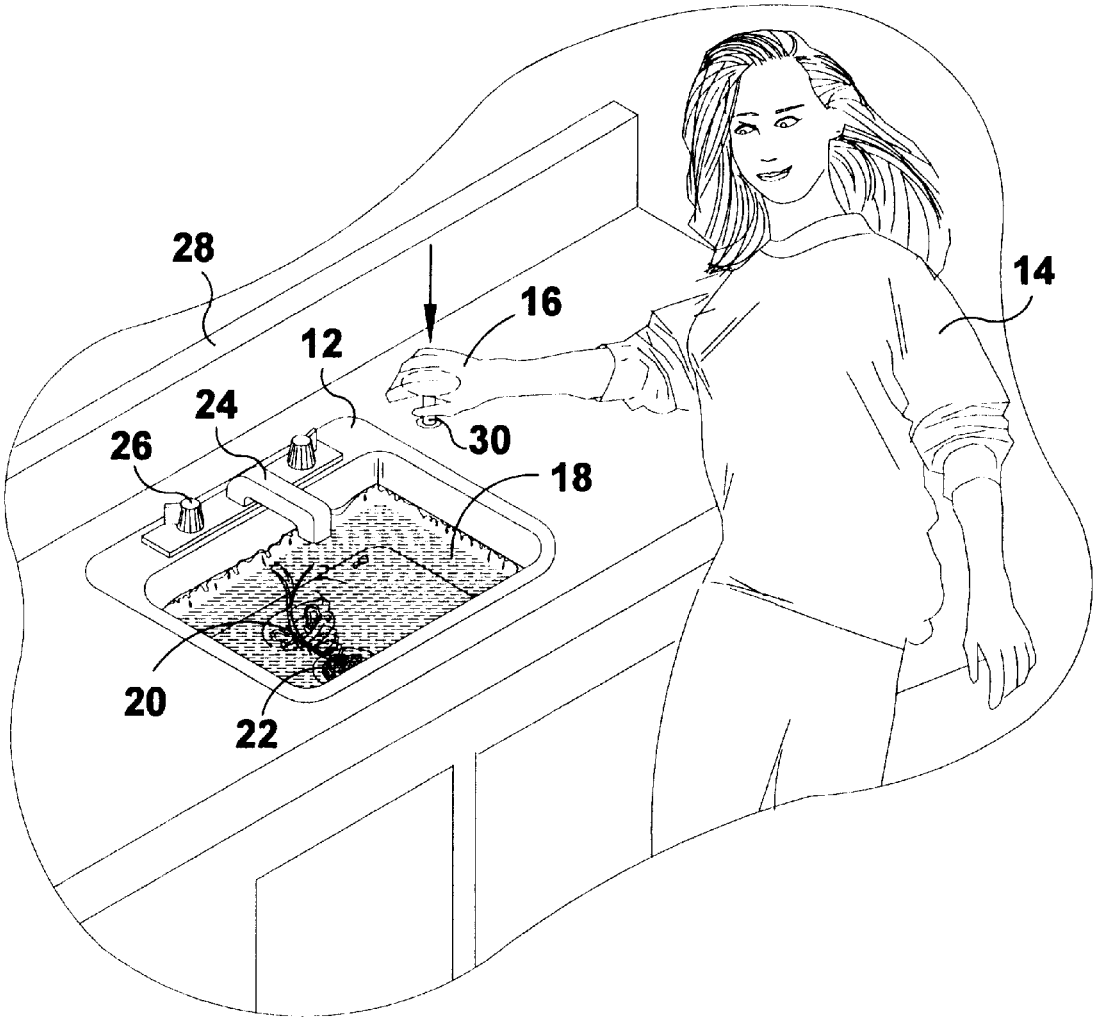
FIG. 1B is an illustration of the present invention in use whereby a user does not have to stick their hand into waste water containing particle matter or sharp objects. It also allows dishes used by guests to be placed in the sink to rinse, soak and discharge the water without putting your hands in to manipulate the strainer basket. The present invention, as shown in the illustration, provides an external valve control mechanism which when depressed moves the drain stem to an upward position thereby allowing the waste water to drain through the strainer into the waste pipe. By pulling up on the external mechanism the ball valve will seat and the sink can be filled.

Turning to FIG. 1B, therein is shown an illustration of the present invention in use whereby the user 14 does not have to stick their hands 16 into the wastewater 18 containing particulate matter or solid waste matter 20 or sharp objects. The present invention as shown in illustration, provides an external remote valve control mechanism or handle 30 which when depressed opens the valve of the present invention thereby allowing the wastewater 18 to drain through the strainer 22 into the waste pipe 32 (not shown). By pulling up oil the external mechanism 30 the ball valve 34 (not shown) will seat and close and the sink 12 can thereafter be filled.

Figure 2:
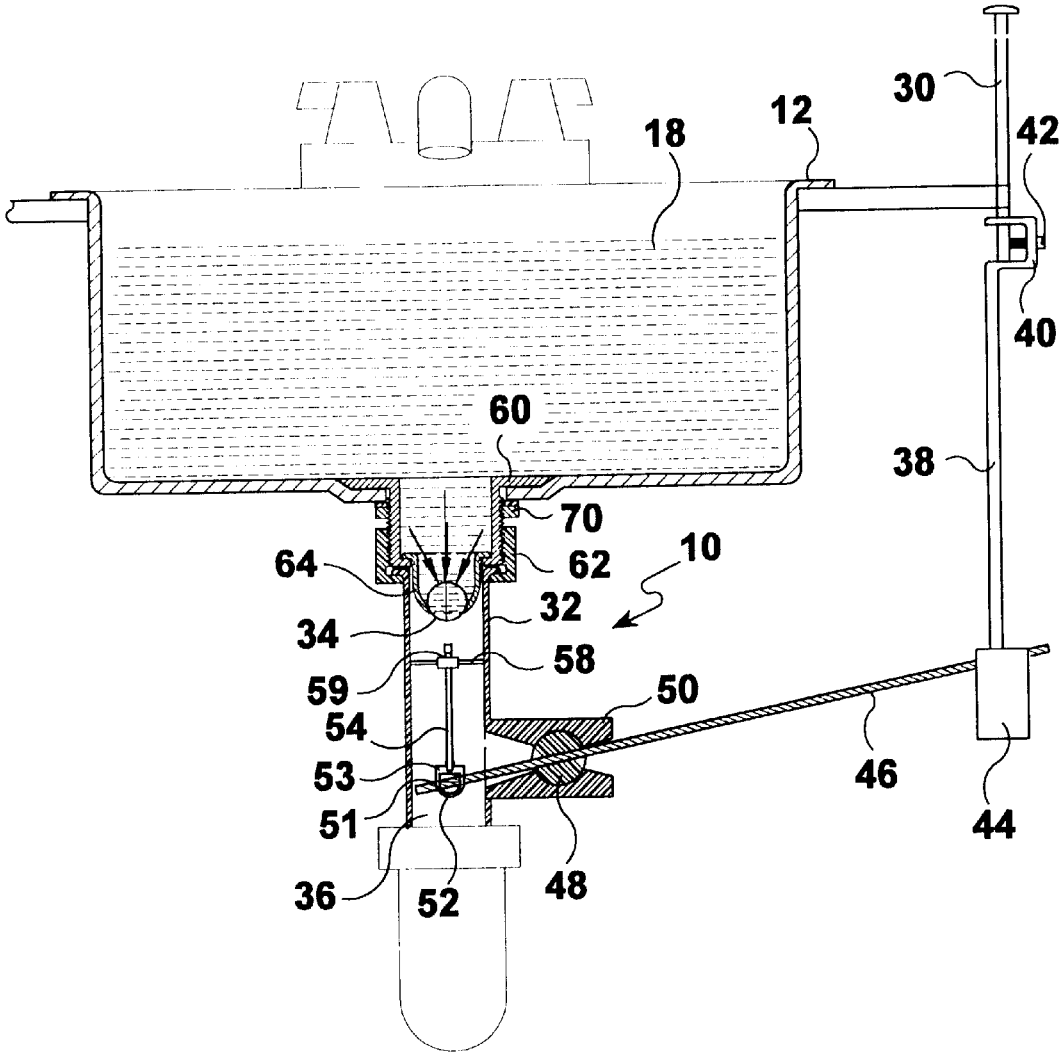
FIG. 2 is a sectional view of the present invention. Shown is a sink full of water with the ball valve seated over the waste pipe aperture. The valve is kept in place by gravity.

Turning to FIG. 2, therein is shown a sectional view of the present invention generally shown at 10. Shown is a sink 12 full of water 18 with the removable ball valve 34 seated over the waste pipe 32 and aperture therein 36. The ball 34 which may be made of metal, glass, plastic or the like, is kept in place by gravity and the gravitational force of the water pushing downward on it. Also shown is the external valve control handle 30 connected to a handle extension rod member 38 by means of a U-shaped adjustable clevis 40 and adjustable tightening screw 42 having connecting means 44 for connecting to a pivot rod 46 which is connected to a pivot ball 48 having a socket-like bushing member 50 within which ball 48 operates. Rod member 46 then connects to another connecting member 52 having an eye 51 therein for receiving pivot rod 46 which thereafter connects to stem member 54 through means 53. Stem 54 passes through an aperture 59 in alignment collar 58 and thereafter contacts ball 34. Also shown is the drain flange housing 60 and locking means 62 and 70 along with an interior lower flange 64 within which the ball seats.

Figure 3:
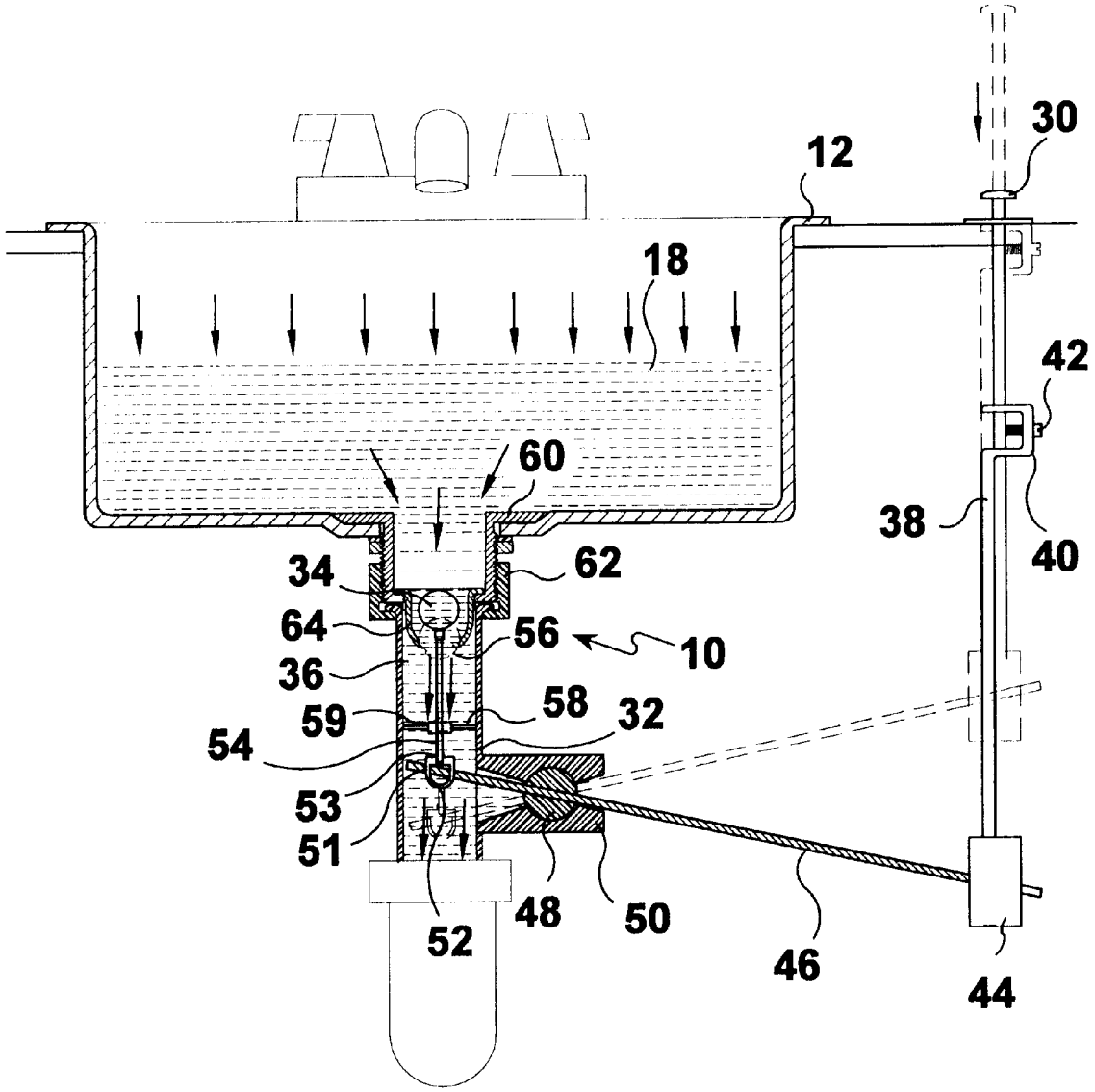
FIG. 3 is a sectional view of the present invention. Shown is the external valve control mechanism in the down position. Thereby moving the ball valve stein upward until it engages and moves the ball valve off of the seat in a vertical direction whereby the water can enter the waste pipe.

Turning to FIG. 3, therein is shown a sectional view of the present invention 10. Shown is the external valve control mechanism 30 in the down position thereby moving the ball valve stem 54 upward until it engages and moves the ball valve 34 off of the ball valve seat 56 in a vertical direction whereby the water 18 can pass ball 34 and enter the waste pipe aperture 36. Other features previously discussed are also shown.

Figure 4:
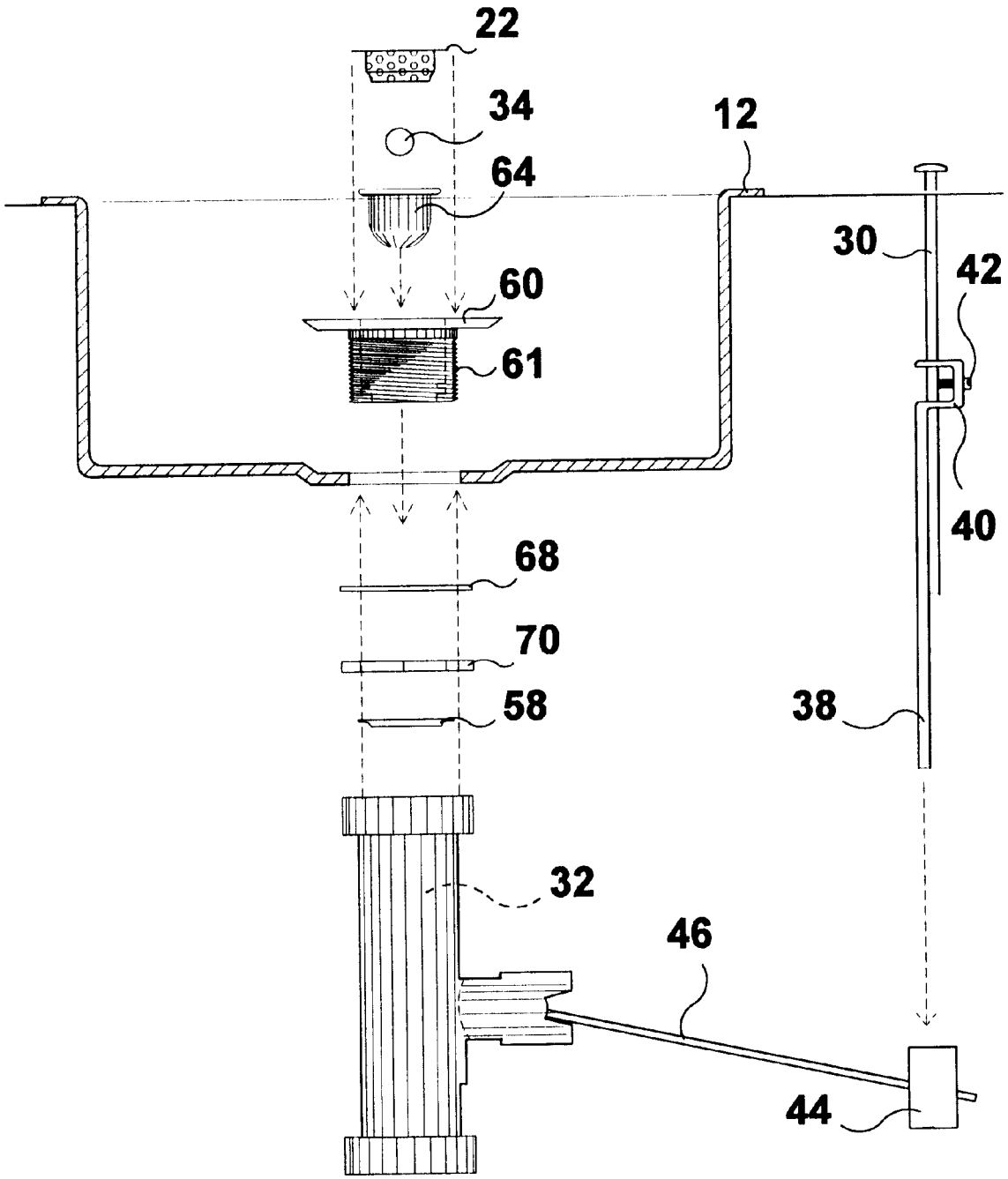
FIG. 4 is an exploded view of the components of the present invention. Shown is pull control mounted to a clevis by means of a set screw. A spring clip which slides over the clevis and positioned over one of a plurality of apertures located within the clevis whereupon the pivot rod is inserted. Said pivot rod acts as the actuator for the stem rod by passing through an aperture in the stem rod. The stem rod passes through an alignment collar whereby the stem rod will be maintained in a central position. The drain flange housing has exterior threading for attachment to the tail piece. Further said drain housing has an interior lower flange whereupon the removable drain cup seat valve is positioned which provides for easy removal and cleaning.

Turning to FIG. 4, therein is shown an exploded view of the components of the present invention. Shown is the control rod 30 mounted to a first clevis 40 by means of a set screw 42. Connecting means 44 connects rod 38 to pivot rod 46 in the standard manner as would be done by one skilled in the art. The pivot rod 46 acts as the actuator for the stem rod 54 (not shown) by passing through an aperture or eye 51 (not shown) in the lower end of the stem rod 46 (not shown). The stem rod 54 (not shown) passes through an alignment collar 58 whereby the stein rod will be maintained in a central position. The drain flange housing 60 has exterior threading 61 for attachment to the tail pipe 32. Further, said drain housing has an interior lower flange 64 whereupon the removable drain ball valve 34 is positioned which provides for easy removal and cleaning of ball 34. The strainer basket 22 is also shown. Washer 68 and locking means, e.g., being a threaded nut are also shown.

Figure 5:
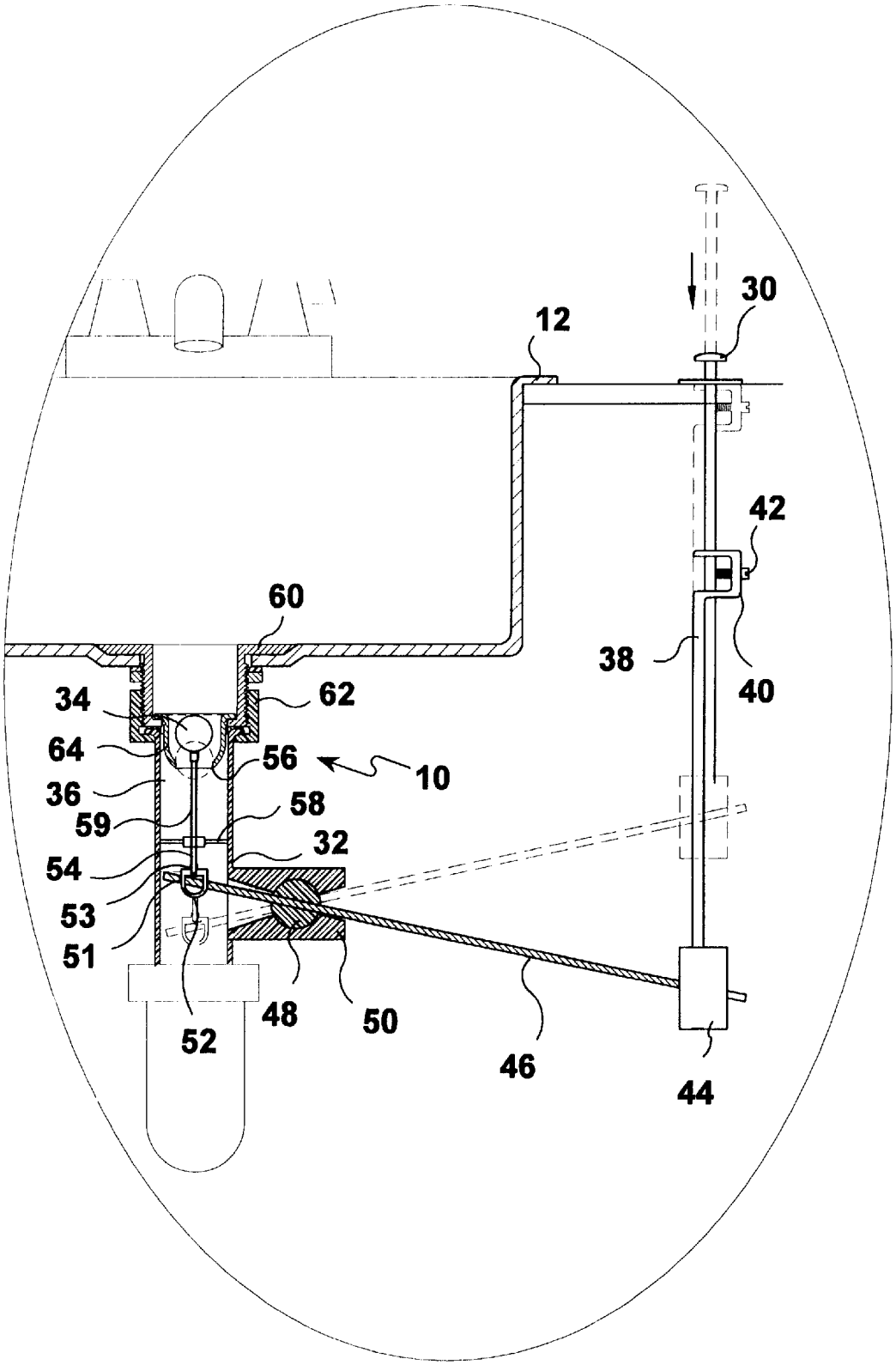
FIG. 5 is an assembled view of the present invention with the external actuator mechanism in the down position causing the ball valve to be moved from the insert aperture thereby allowing the water into the waste pipe or removal of the insert and ball valve.

Turning to FIG. 5, therein is shown an assembled view of the present invention 10 with the external actuator mechanism 30 in the down position causing the ball valve 34 to be moved from the insert aperture or seat 56 thereby allowing the dishwater to enter the waste pipe 32 and for removal of the insert 64 and ball valve 34. Other features previously discussed are also shown.

Figure 6:
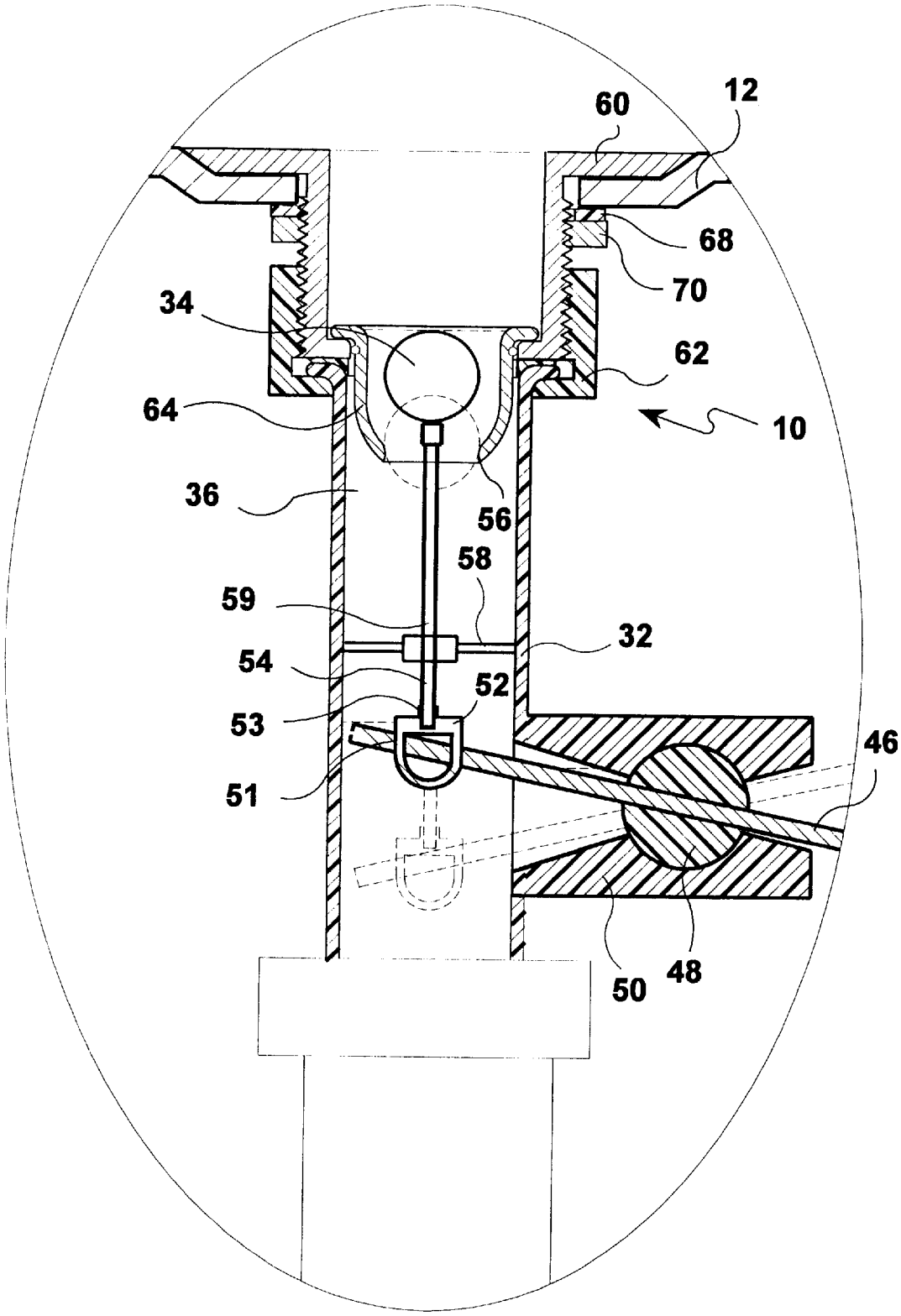
FIG. 6 is an exploded view of the ball valve having been removed from the valve insert by means of the pivot arm. The insert and the ball are easily removed through the drainage aperture located at the bottom of the sink.

Turning to FIG. 6, therein is shown an exploded view of the ball valve 34 having been removed from the valve insert 64 by means of the stem 54. The insert 64 and the ball 34 are easily removed through the drainage aperture 66 located in the drain flange housing 60 at the bottom of the sink. Also shown is washer 68 and locking means 70 for securing the drain flange housing 60 to the sink 12. Other features previously discussed are also shown.

What is claimed to be new and desired to be protected by Letters Patent is set forth in the claims:

1. An apparatus for a pop-up drain valve for installation in a sink comprising:

a) a freely movable and unattached ball;

b) an annular ball seat having a central opening wherein said ball rests by gravity closing said central opening;

c) a waste pipe having a top opening;

d) a lower flange member comprising said annular ball seat;

e) a drain flange member having a bottom opening for receiving said lower flange member and connected to said top opening in said waste pipe whereby said ball sitting on said seat blocks off entry into said waste pipe;

f) means comprising a flange for connecting said drain flange member to an opening in the sink, said lower flange member extending through said bottom opening of said drain flange member and having a flange for freely and unattachedly suspending said lower flange member from said drain flange member, said lower flange member and ball being removable from said drain flange member by lifting both out through said sink;

g) means for making contact with and moving said ball upwardly to allow said sink to drain;

h) said means for making contact with and moving said ball comprising a generally vertically extending movable stem within said waste pipe having a free upper end for making contact with said ball when said stem is raised and a lower, enlarged end with an opening therethrough;

i) a pivot rod extending into said waste pipe having a proximate end for engaging said stem through the opening in the enlarged end of said stem, said pivot rod passing through a pivot ball mounted on the outside of said waste pipe within a socket-like bushing member, said pivot rod having a distal end for connecting to an extension rod of a control handle;

j) said control handle adapted for extending up through a counter top in which said sink is mounted, said control handle being remotely positioned away from said sink when installed;

k) means within said waste pipe comprising an alignment collar having a centrally located aperture therein through which said stem passes for aligning said stem in said waste pipe to make contact with said ball;

l) said control handle being connected to said pivot rod by means of a clevis, said clevis having an adjustment screw; and m) a locking member threadably engaged to said drain flange member for connecting the top opening of said waste pipe to said drain flange member.

* * * * *